US006067683A

United States Patent [19]

Reeves

[11] Patent Number: 6,067,683

[45] Date of Patent: May 30, 2000

[54] CAULK FINGER CLEANER

[76] Inventor: Richard L. Reeves, P.O. Box 6163, Mobile, Ala. 36660-0163

[21] Appl. No.: 09/223,138

[22] Filed: Dec. 30, 1998

[51] Int. Cl.[7] ..... A47L 25/00

[52] U.S. Cl. ..... 15/105; 15/236.01; 222/192

[58] Field of Search ..... 15/105, 105.5, 15/235.4, 256.01, 236.03, 246, 257.05, 260; 222/324–327, 192; 425/458

[56] References Cited

U.S. PATENT DOCUMENTS

| | | | |
|---|---|---|---|
| D. 326,593 | 6/1992 | Ward . | |
| D. 388,672 | 1/1998 | Kleder et al. | D8/14.1 |
| 1,017,753 | 2/1912 | Harrison | 15/246 |
| 1,256,282 | 2/1918 | Akerlund | 15/246 |
| 1,759,091 | 5/1930 | Brooks et al. | 15/246 |
| 2,536,215 | 1/1951 | Povondra | 15/236.01 |
| 3,436,784 | 4/1969 | Moore | 15/257.05 |
| 3,555,589 | 1/1971 | Quimby | 15/260 |
| 3,744,079 | 7/1973 | Krause . | |
| 4,669,635 | 6/1987 | Brookhart . | |
| 4,849,607 | 7/1989 | Meo | 15/246 |
| 5,220,701 | 6/1993 | Creato et al. . | |
| 5,228,605 | 7/1993 | Schichenmaier | 222/327 |
| 5,239,725 | 8/1993 | White . | |

*Primary Examiner*—Terrence R. Till
*Attorney, Agent, or Firm*—Donald A. Kettlestrings

[57] ABSTRACT

Apparatus for use with a conventional caulking gun for enabling a user to clean caulk from the user's finger or fingers includes an open-topped receptacle defining an upper edge and a finger-receiving cut-out portion defined within the edge. Clips are connected to the receptacle for cooperating with the caulking gun and removably holding the apparatus in fixed position with respect to the gun so that the user can wipe his finger or fingers across the edge within the cut-out portion to remove caulk from the user's finger and to neatly collect the removed caulk within the receptacle.

13 Claims, 1 Drawing Sheet

CAULK FINGER CLEANER

BACKGROUND OF THE INVENTION

This invention relates to apparatus for cleaning caulk from a finger or fingers and more particularly to apparatus for removable connection to a conventional caulking gun for enabling a user to clean caulk from the user's finger or fingers.

During the conventional caulking process, the user spreads and smooths caulk with his finger after the caulk is applied to the surface being caulked. The caulk adheres to and collects on the finger or fingers, and it is typically necessary to use a rag to remove the caulk from the user's fingers. The caulk collected on the rag makes it difficult for the user to carry or otherwise maintain the rag without unintentionally depositing the caulk from the rag onto the user's clothing or onto other surfaces. Frequently, an excessive amount of caulk will be collected onto the rag so that the rag cannot adequately retain the caulk, and the excess caulk will drop from the rag in an undesirable manner.

It is, therefore, an object of the present invention to provide a caulk finger cleaner.

Another object is to provide such a cleaner which will enable the user of a conventional caulking gun to quickly, easily and neatly clean his fingers during the caulking process.

A further object of the invention is the provision of such a cleaner which can be quickly and easily removably attached to a conventional caulking gun.

Still another object is to provide a caulk finger cleaner which will neatly collect caulk removed from the user's finger or fingers.

Yet another object of the present invention is the provision of a caulk finger cleaner which can be cleaned or disposed of after the user has finished the caulking procedure.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides apparatus for use with a conventional caulking gun for enabling a user to clean caulk from the user's finger or fingers, the apparatus comprising: an open-topped receptacle defining at least a first upper edge; and means connected to the receptacle for cooperating with the caulking gun and holding the apparatus in predetermined fixed position with respect to the gun, whereby the user can wipe his finger or fingers across the edge to remove caulk from the user's finger or fingers and to collect the removed caulk within the receptacle.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description,, serve to explain the principles of the invention.

DESCRIPTION OF THE PREFERRED EMBODIMENT

Figure 1:
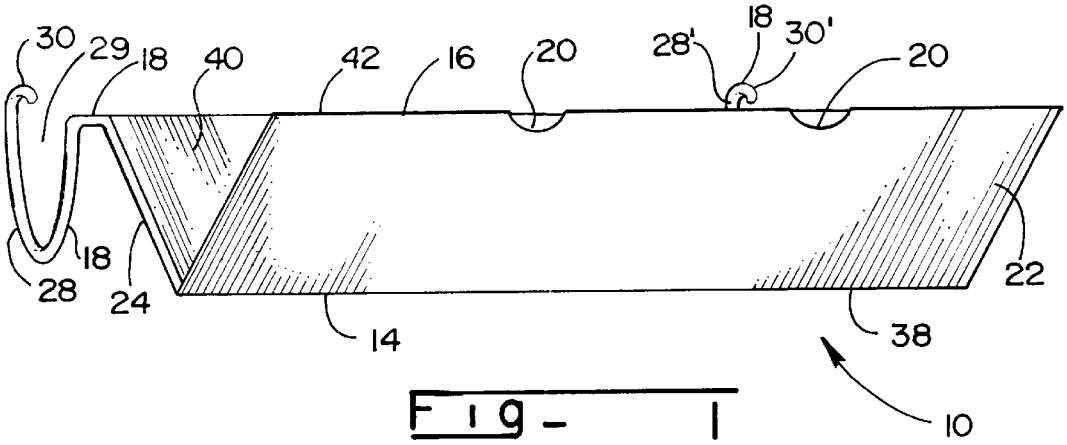
FIG. 1 is a perspective view of the caulk finger cleaning apparatus.
Figure 2:
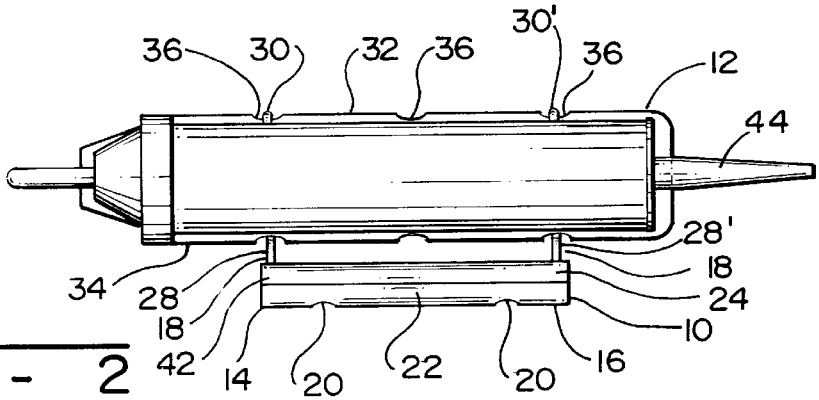
FIG. 2 is a top plan view showing a conventional caulking gun containing a conventional caulk containing tube positioned within the gun and showing the caulk finger cleaning apparatus held in position on the gun.
Figure 3:
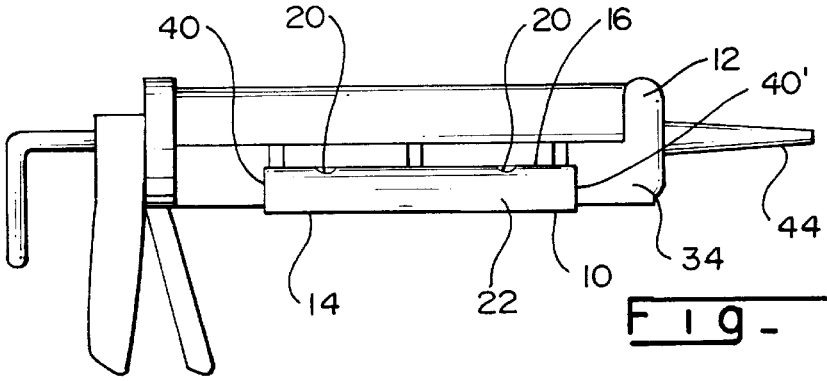
FIG. 3 is a side elevation view of the assembly shown in FIG. 2.

With reference now to the drawings, wherein like reference characters designate like or corresponding parts throughout the several views, there is shown apparatus 10 in accordance with the invention for use with a conventional caulking gun 12 for enabling a user to clean caulk from the user's finger or fingers. Apparatus 10 includes an open-topped receptacle 14 defining a first upper edge 16. Apparatus 10 further includes means generally indicated at 18 connected to receptacle 14 for cooperating with caulking gun 12 and holding apparatus 10 in predetermined fixed position with respect to gun 12 so that the user can wipe his finger or fingers across edge 16 to remove caulk from the user's finger or fingers and to collect the removed caulk within receptacle 14.

Upper edge 16 preferably defines at least a first finger-receiving, cut-out portion 20 within edge 16 so that the user can wipe his finger or fingers across edge 16 within cut-out portion 20 to remove caulk from the user's finger or fingers and to collect the removed caulk within receptacle 14. A plurality of cut-out portions 20 can be provided within edge 16.

Receptacle 14 includes a first outer side element 22, and side element 22 defines upper edge 16. Receptacle 14 further includes a second inner side element 24 defining a second upper edge 26. Holding means 18 preferably include first and second clips 28, 28' connected to and extending outwardly from side element 24 adjacent to edge 26 for fitting around and grasping gun 12 to removably hold receptacle 14 in fixed position with respect to gun 12.

Each of clips 28, 28' preferably defines a hooked end 30, 30', respectively, for hooking over conventional edge 32 of gun 12 when clips 28, 28' are fitted around and grasp exterior 34 of gun 12. Each of clips 28, 28' is preferably comprised of flexible, resilient plastic material, and each of clips 28, 28' is shaped and dimensioned to tightly grip exterior portion 34 of gun 12.

Each of clips 28, 28' preferably defines an open-ended, U-shape for enabling clips 28, 28' to be positioned or snapped into gripping relationship with exterior portion 34 of gun 12 and for enabling the clips to be removed from gripping relationship with exterior portion 34 of gun 12.

Exterior portion or surface 34 of conventional caulking gun 12 may typically define a plurality of depressions or channels 36, and clips 28, 28' are preferably located a predetermined distance apart from each other so that the clips can be positioned within channels 36 when apparatus 10 is connected to caulking gun 12. The positioning of clips 28, 28' within channels 36 helps to hold the clips in fixed and stable position as they grasp exterior 34 of gun 12.

Receptacle 14 is preferably V-shaped in configuration, and upper edges 16, 26 are preferably parallel to each other. Side elements 22, 24 are connected together at edge 38 to form a V-shape, and opposed end elements 40, 40' are connected to and extend between side elements 22, 24 to form open-topped receptacle 14. Receptacle 14 can be other than V-shaped.

Open ends 29 of U-shaped clips 28, 28' and open top 42 of receptacle 14 are oriented in the same direction so they face generally upwardly during use of gun 12.

In operation and use, apparatus 10 is securely attached to the side of caulking gun 12 by positioning flexible, resilient clips 28, 28' around exterior portion 34 of gun 12 and by positioning hooked ends 30, 30' over edge 32 of gun 12. A caulk containing tube 44 is positioned within gun 12 in a conventional manner, and the caulking process can begin. After the caulk is laid in position during the caulking process and after the user has smoothed and spread the caulk with his finger or fingers, the user can clean his finger or fingers by wiping them across cut-out portions 20 in edge 16 of outer side element 22. Caulk from the user's finger or fingers will be collected within receptacle 14 as it is scraped from the user's finger or fingers. When the user has finished his caulking job, he can detach apparatus 10 from caulking gun 12 by removing flexible, resilient clips 28, 28' from the gun. Apparatus 10 can then be cleaned or disposed of.

The invention in its broader aspects is not limited to the specific details shown and described, and departures may be made from such details without departing from the principles of the invention and without sacrificing its chief advantages.

What is claimed is:

1. Apparatus for use with a conventional caulking gun for enabling a user to clean caulk from the user's finger or fingers, said apparatus comprising:

an open-topped receptacle defining at least a first upper edge; and means connected to said receptacle for cooperating with said caulking gun and holding said apparatus in predetermined fixed position with respect to said gun, whereby the user can wipe his finger or fingers across said edge to remove caulk from the user's finger or fingers and to collect said removed caulk within said receptacle.

2. Apparatus as in claim 1 wherein said first upper edge defines at least a first finger-receiving, cut-out portion within said edge, whereby the user can wipe his finger or fingers across said edge within said cut-out portion to remove caulk from the user's finger or fingers and to collect said removed caulk within said receptacle.

3. Apparatus as in claim 2 wherein said receptacle includes at least a first side element and wherein said first side element defines said first upper edge.

4. Apparatus as in claim 3 wherein said receptacle further includes a second side element defining a second upper edge and wherein said holding means include first and second clips connected to and extending outwardly from said second side element for fitting around and grasping an exterior portion of said gun to hold said receptacle in said fixed position with respect to said gun.

5. Apparatus as in claim 4 wherein each of said clips defines a hooked end for hooking over said gun when said clips are fitted around and grasp said gun.

6. Apparatus as in claim 5 wherein each of said clips is comprised of flexible, resilient material.

7. Apparatus as in claim 6 wherein each of said clips is shaped and dimensioned to tightly grip an exterior portion of said gun.

8. Apparatus as in claim 7 wherein each of said clips defines an open-ended substantially U-shape for enabling said clips to be positioned in gripping relationship with an exterior portion of said gun and for enabling said clips to be removed from said gripping relationship with said exterior portion of said gun.

9. Apparatus as in claim 8 wherein said first and second upper edges are substantially parallel to each other.

10. Apparatus as in claim 9 wherein said first and second side elements are connected together to form a substantially V-shape, and wherein first and second opposed end elements are connected to and extend between said side elements to form said open-topped receptacle.

11. Apparatus as in claim 10 wherein said open ends of said U-shaped clips and said open top of said receptacle are oriented in substantially the same direction.

12. Apparatus as in claim 11 wherein said clips and said receptacle are comprised of plastic.

13. Apparatus as in claim 4 wherein said exterior portion of said gun defines a plurality of channels and wherein said clips are located a predetermined distance apart from each other for enabling said clips to be positioned within said channels when said apparatus is connected to said gun.

* * * * *